US006551158B2

(12) United States Patent
Murphy

(10) Patent No.: US 6,551,158 B2
(45) Date of Patent: Apr. 22, 2003

(54) ADJUSTABLE ANGLED REAR WING

(76) Inventor: Michael Murphy, 33124 Case St., Lake Elsinore, CA (US) 92530

( * ) Notice: Subject to any disclaimer, the term of this patent is extended or adjusted under 35 U.S.C. 154(b) by 0 days.

(21) Appl. No.: 10/081,591

(22) Filed: Feb. 20, 2002

(65) Prior Publication Data

US 2002/0115363 A1 Aug. 22, 2002

Related U.S. Application Data

(60) Provisional application No. 60/269,476, filed on Feb. 20, 2001.

(51) Int. Cl.[7] ..... B63B 35/85

(52) U.S. Cl. ..... 441/72; 114/280; 441/65; 441/79

(58) Field of Search ..... 114/274, 280; 441/65, 72, 79

(56) References Cited

U.S. PATENT DOCUMENTS

| | | | | |
|---|---|---|---|---|
| 2,452,280 A | | 10/1948 | Zahller | |
| 2,707,986 A | | 5/1955 | Johnson | |
| 2,721,088 A | | 10/1955 | Ritter, Jr. | |
| 3,260,232 A | * | 7/1966 | Douglas | 114/126 |
| 3,325,179 A | | 6/1967 | Bissett | |
| 4,014,283 A | | 3/1977 | Crnogorac | |
| 4,193,609 A | | 3/1980 | Bissett | |
| 4,260,036 A | | 4/1981 | Bissett | |
| D261,022 S | | 9/1981 | Hoskins | |
| 4,421,193 A | | 12/1983 | Bissett | |
| 5,100,354 A | * | 3/1992 | Woolley et al. | 114/253 |
| 5,249,998 A | | 10/1993 | Woolley et al. | |
| 5,309,861 A | | 5/1994 | Mardikian | |
| 5,329,870 A | | 7/1994 | Cook | |
| 5,367,978 A | | 11/1994 | Mardikian | |
| 5,518,080 A | | 5/1996 | Pertile | |
| 5,603,281 A | | 2/1997 | Harvey et al. | |
| 5,911,191 A | | 6/1999 | Burer | |
| 6,179,676 B1 | | 1/2001 | Wilborn et al. | |
| 6,234,856 B1 | * | 5/2001 | Woolley | 114/253 |
| 6,443,786 B2 | * | 9/2002 | Woolley | 441/65 |

* cited by examiner

*Primary Examiner*—Sherman Basinger
(74) *Attorney, Agent, or Firm*—Joseph E. Mueth

(57) ABSTRACT

A water sport device for supporting a seated human rider while the rider and the device are towed behind a powered water craft, including an elongate board to which a seat and foot holder are secured, an elongate hydrofoil extending downward from the board and a planing blade secured to the hydrofoil generally parallel to the board so that the planing blade provides essentially no lift when the board is horizontal. The improvements comprise an adjustable rear blade to permit the rear blade to be manually adjusted to increase or decrease the space between the blades; and the rear blade is shaped to have an angle which slopes downward from the top surface to its leading edge and a thin rear trailing edge.

4 Claims, 5 Drawing Sheets

ADJUSTABLE ANGLED REAR WING

This patent application claims the filing date of U.S. Provisional Patent Application Ser. No. 60/269,476, filed Feb. 20, 2001.

BACKGROUND OF INVENTION

U.S. Pat. Nos. 5,100,354, 5,249,998 and 6,179,676 B1 disclose a water sport device for supporting a seated human rider while the rider and the device are towed behind a powered water craft. The device includes an elongated board to which a rigidly mounted seat and foot holders are secured. An elongate strut in the shape of a hydrofoil projects downwardly from the board. The lower end of the strut carries an arm which is generally parallel to the board. Front and rear planing blades are carried by the arm. The positioning of the rigidly mounted seat and the planing blades, the use of a single vertical strut, the size of the planing blade and the positioning of the foot holders provides a water sports device which is relatively easy to ride, while at the same time being highly maneuverable and capable of high jumps.

The present invention provides significant improvements in this water sport device.

SUMMARY OF INVENTION

First Embodiment

In a water sports device for supporting a seated human rider while the rider and the device are towed behind a powered water craft, the device including an elongated board having a front end and a back end to which is secured a seat for supporting the buttocks of the rider in a position spaced from and roughly centered above the back one-third of the board, a holder for securing the feet of the rider over the top of the board secured to the board spaced at least about two feet toward the front end of the board from the seat, an elongated hydrofoil extends downward from the board, front and rear planing blades carried by an arm which is generally parallel to the board, said arm being secured to the hydrofoil and spaced from the board, so that the blades are generally parallel to the board, the planing blades provide essentially no lift when the board is horizontal;

the improvement wherein the distance between the front and rear planing blades can be changed fore and aft by adjustment of the position of the rear blade so that the advanced rider can move the rear blade forward to make the device more responsive and thereby create higher jumps, and the less experienced rider can move the rear blade further to the rear of the front blade to make the device less responsive.

Second Embodiment

In a water sports device for supporting a seated human rider while the rider and the device are towed behind a powered water craft, the device including an elongated board having a front end and a back end to which is secured a seat for supporting the buttocks of the rider in a position spaced from and roughly centered above the back one-third of the board, a holder for securing the feet of the rider over the top of the board secured to the board spaced at least about two feet toward the front end of the board from the seat, an elongated hydrofoil extends downward from the board, front and rear planing blades carried by an arm which is generally parallel to the board, said arm being secured to the hydrofoil and spaced from the board, so that the blades are generally parallel to the board, the planing blades provide essentially no lift when the board is horizontal;

the improvement wherein said rear planing blade has an angle which slopes downward from the top surface to its leading edge whereby the device is more stable and less prone to porpoising.

The first improvement by creating an adjustable rear blade enables an advanced rider to move the rear blade forward on the arm to reduce the space between the planing blades. This makes the entire water sports device more responsive so that when the rider leans back, the device comes out of the water and the height of the jump is greater. Conversely, for the less experienced rider, the spacing between the blades can be increased, which increases the stability by reducing the responsiveness.

The second improvement pertains to an improvement in the shape of the rear blade. In the prior water sports device, the rear blade sloped upward from the underside of the blade to the leading edge. In the present invention, the angle is downward at an increasing angle on the top surface of the rear planing blade to the leading edge. The trailing edge is thinned out on the underside of the rear planing blade. The new downward angle stabilizes the rider by creating a torque or "tow in" that reduces the porpoising or up and down pitching effect observed in riding the devices of the prior art referred to hereinabove.

DESCRIPTION OF THE PREFERRED EMBODIMENT

Turning to the drawings in greater detail.

Figure 1:
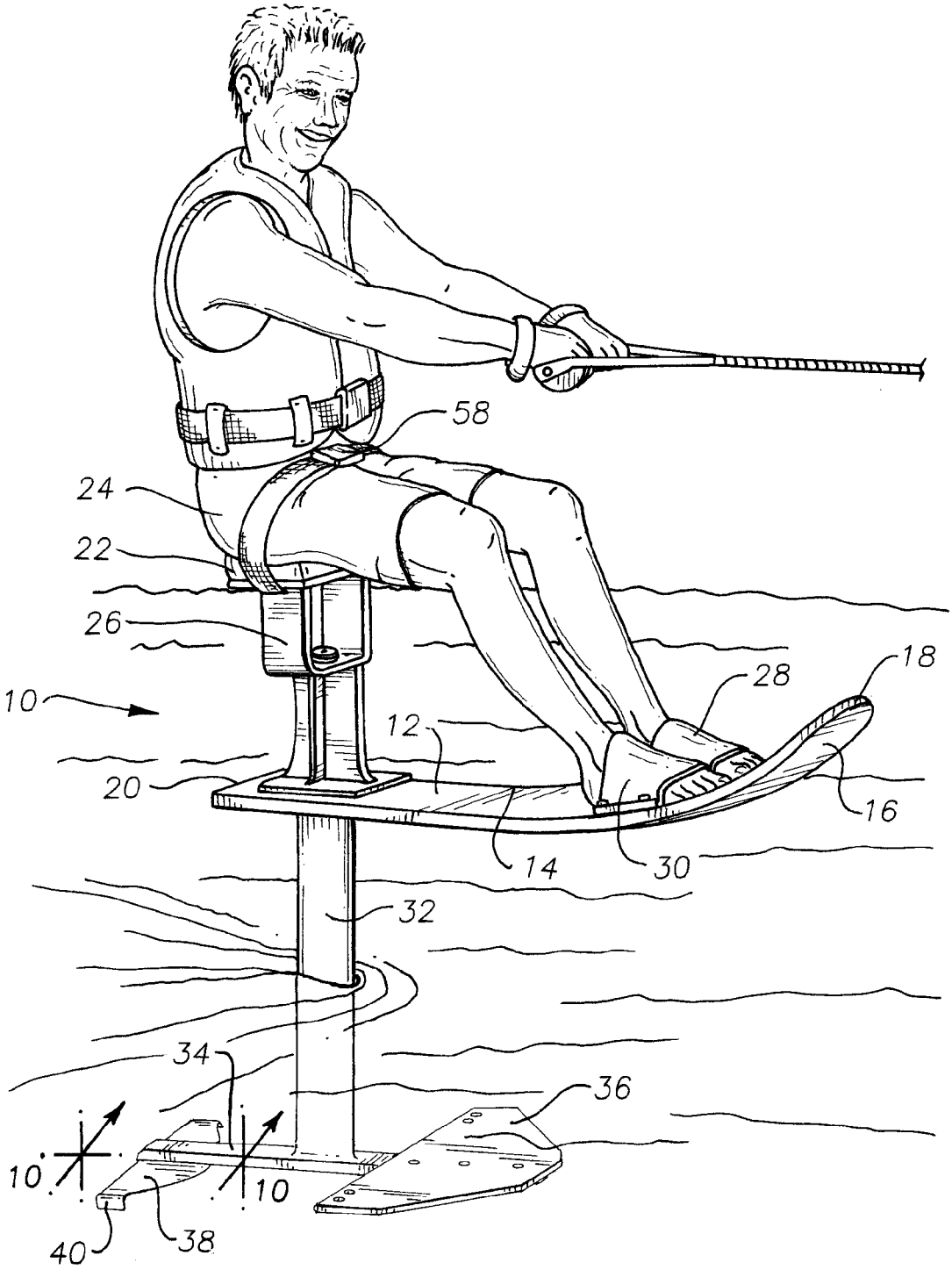
FIG. 1 is an overall perspective view of the water sport device of the invention with a rider being towed.

Referring to FIG. 1, there is shown a "flying ski" 10 which embodies the preferred design of the water sports device present invention. The flying ski 10 includes an elongate board 12 having an upper surface 14 and a lower surface 16, and a front end 18 and a back end 20. A seat 22 extends generally perpendicular to and upward from the upper surface 14 of the board for supporting the buttocks of a seated rider 24 at a point spaced above the back of the board.

The seat 22 is carried by the support member 26.

The rider's legs extend forward toward the front of the board, where they are secured by a holders 28, such as a pair of rubber sheets 30, which are attached to the board about two feet forwardly of seat 22 so as to form two elongate generally semicircular loops into which the feet of the rider can be inserted.

An elongate hydrofoil 32 extends generally perpendicular to and thru a tight fitting opening in the board 10, and is secured to support 26. The portion of hydrofoil 32 extending below the board 12 is of a water foil shape in cross section. The upper end of the hydrofoil 32 can be affixed to the board 10, generally beneath support member 26. The arm 34 having a forward end and rearward end is fixed to the bottom end of the hydrofoil 32 at a point just forward of the middle of the arm 34. A forward planing blade 36 is secured to the top of the forward end of the arm 34 so as to be generally parallel to the board 12. The adjustable rear planing blade 38 is secured to the bottom of the rearward end of the arm 34 generally parallel to the board 12. A pair of vertical fins 40 can be secured to the bottom of the rear planing blade 38 on either side of the arm 34. The planing blade structure (i.e., the hydrofoil 32, the arm 34, the forward planing blade 36, the adjustable rear planing blade 38), provides essentially no lift when the board 12 is horizontal.

Figure 10:
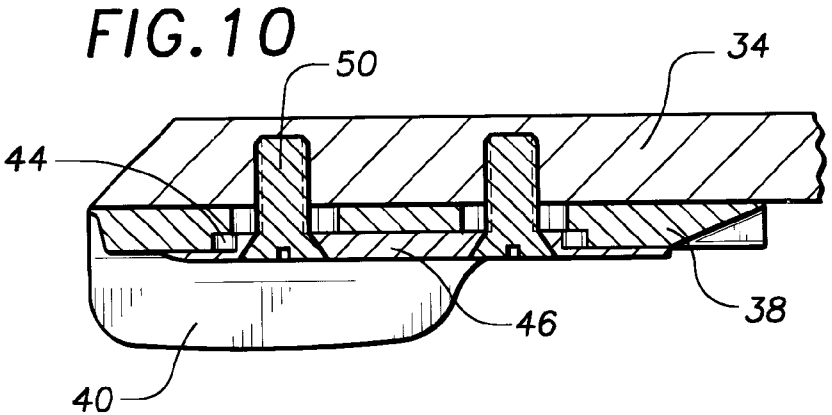
FIG. 10 is a partial enlarged section taken along the line 10—10 in FIG. 1, showing the attachment of the rear wing to the arm.
Figure 11:
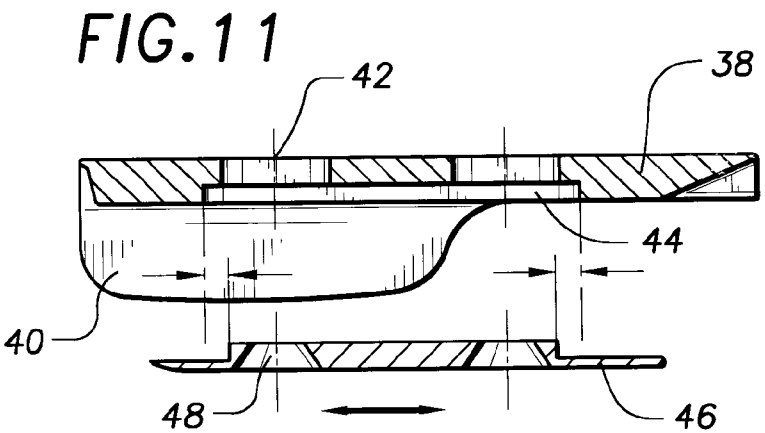
FIG. 11 is similar to FIG. 10, without the elongate arm and in disassembled state to show the adjustability of the rear planing wing 38.
Figure 9:
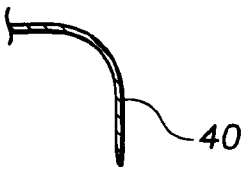
FIG. 9 is a sectional view taken along the line 9—9 in FIG. 2.
Figure 7:
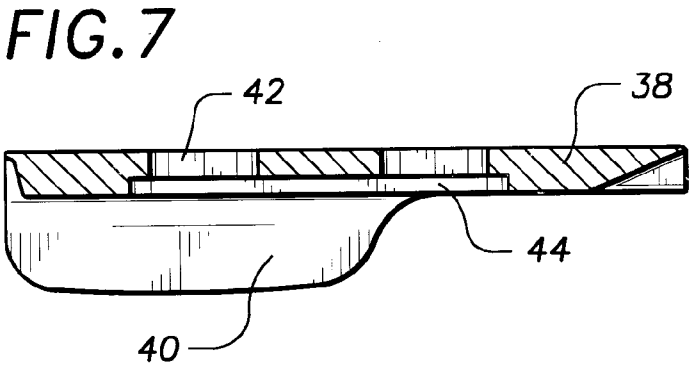
FIG. 7 is a sectional view taken along the line 7—7 in FIG. 2.

Considering FIGS. 7, 10 and 11, the rear blade 38 is provided with two elongated through holes 42. The underside of rear blade 38 has a cutout 44 which is adapted to receive an adjustment plate 46. The cutout 44 is somewhat longer than the adjustment plate 46. The adjustment plate 46 has two holes 48 in which are received bolts 50 fixed in the arm 34. When the bolts 50 are loosened, the blade 38 can slide fore and aft on the bolts 50. The bolts can be tightened to sandwich the rear blade 38 between arm 34 and adjustment plate 46 in any desired position, as shown in FIG. 10. This provides for adjustment of the space between the front blade 36 and rear blade 38.

Figure 2:
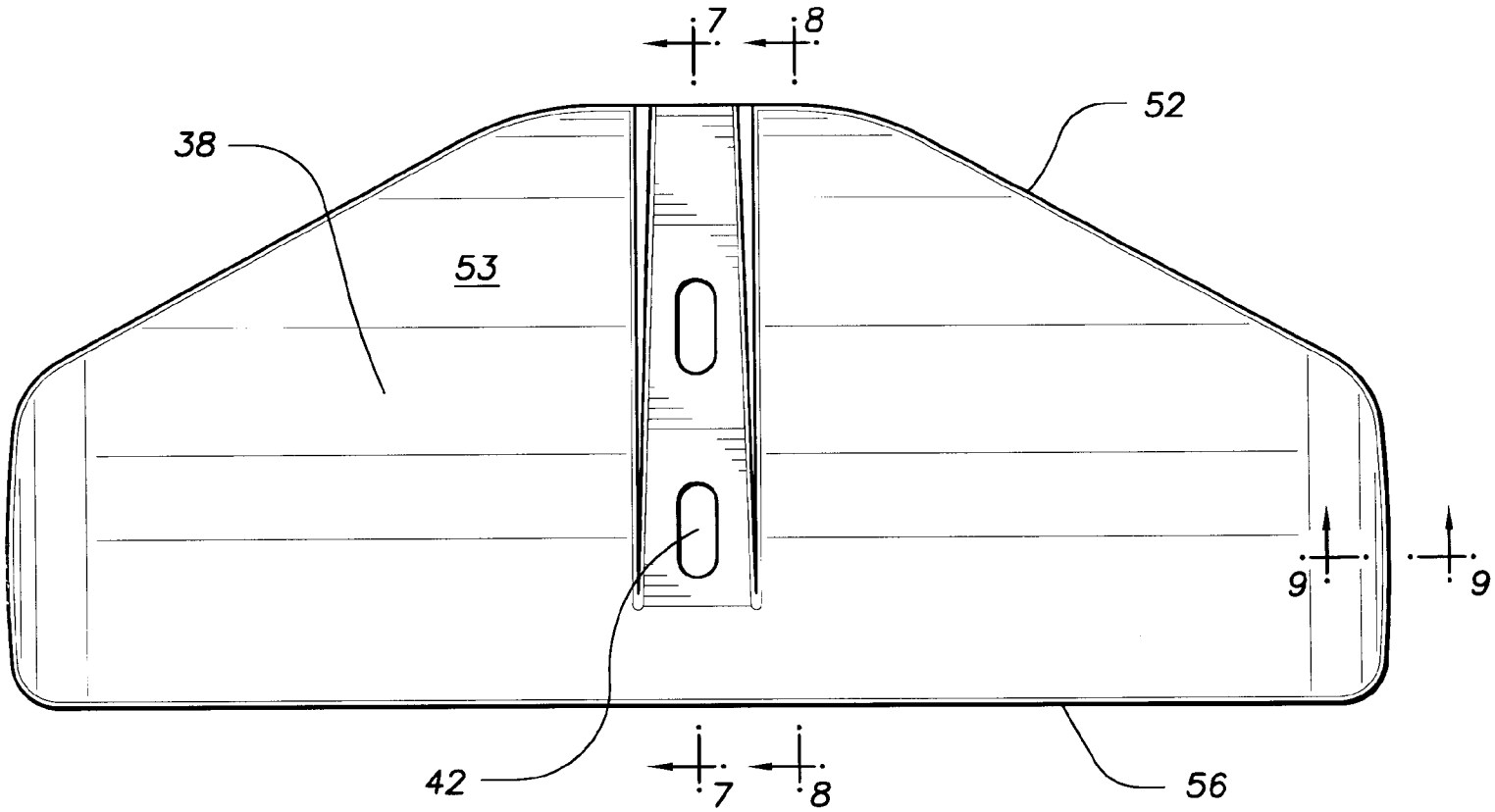
FIG. 2 is a top view of the rear wing of the device shown in FIG. 1.
Figure 3:
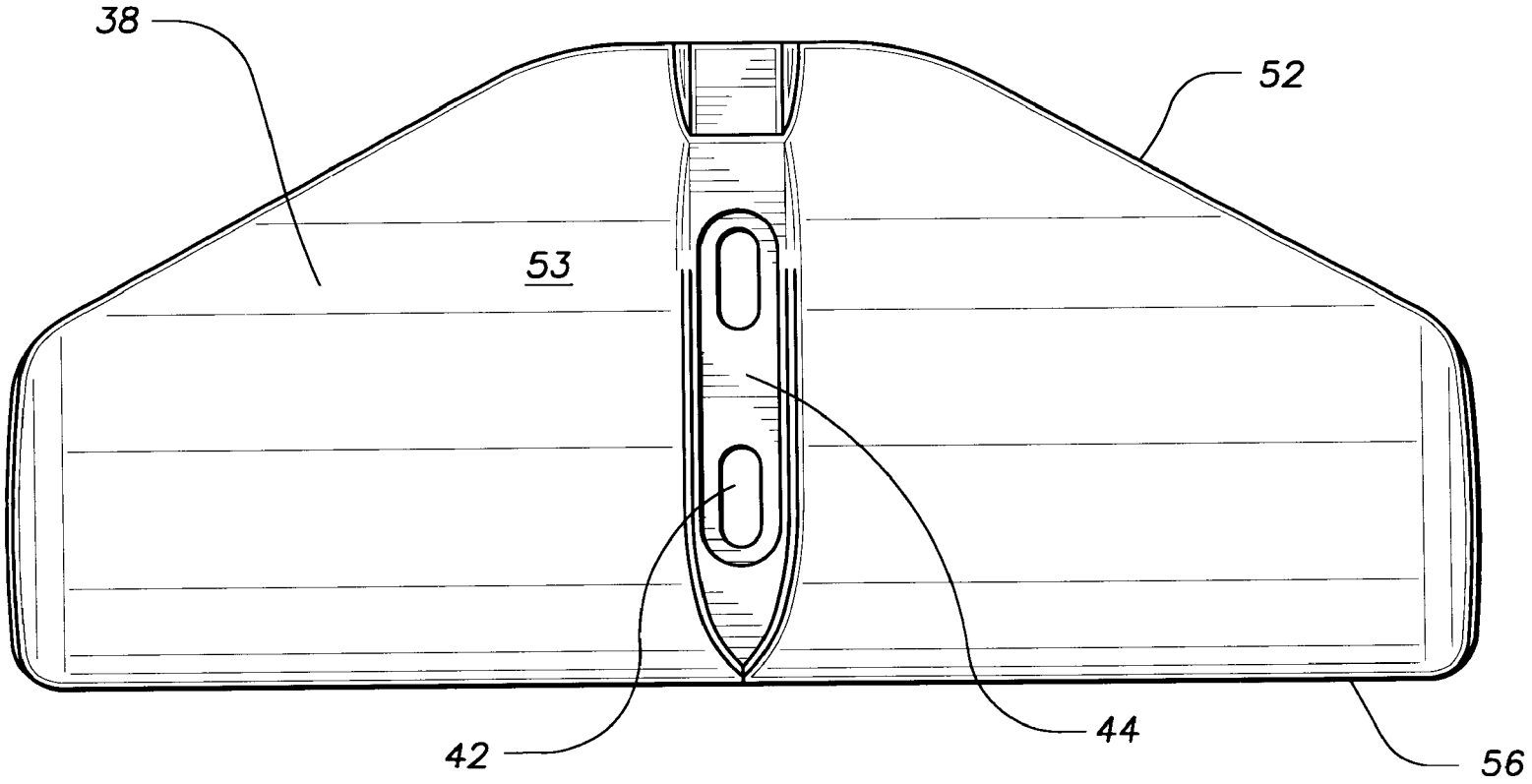
FIG. 3 is bottom view of the underside of the rear wing of FIG. 2.
Figure 4:
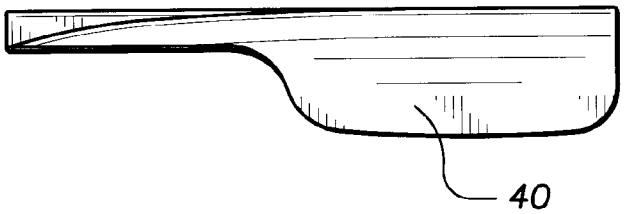
FIG. 4 is a side plane view of the rear wing of FIG. 2.
Figure 5:
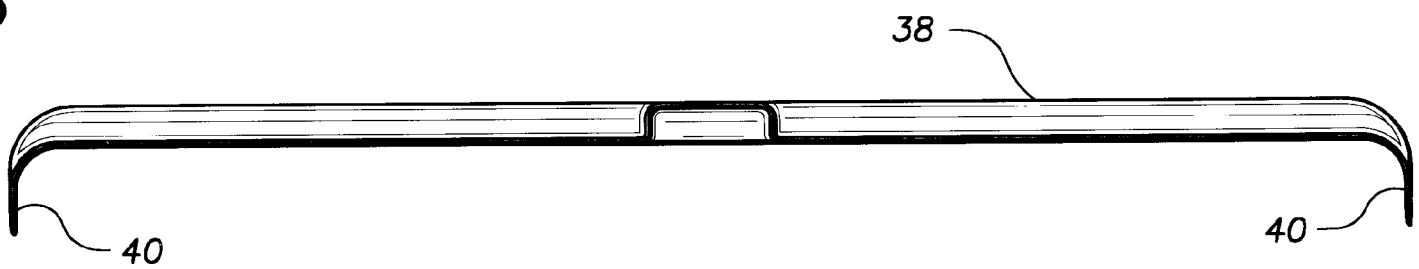
FIG. 5 is a front plan view of the device of FIG. 2.
Figure 6:
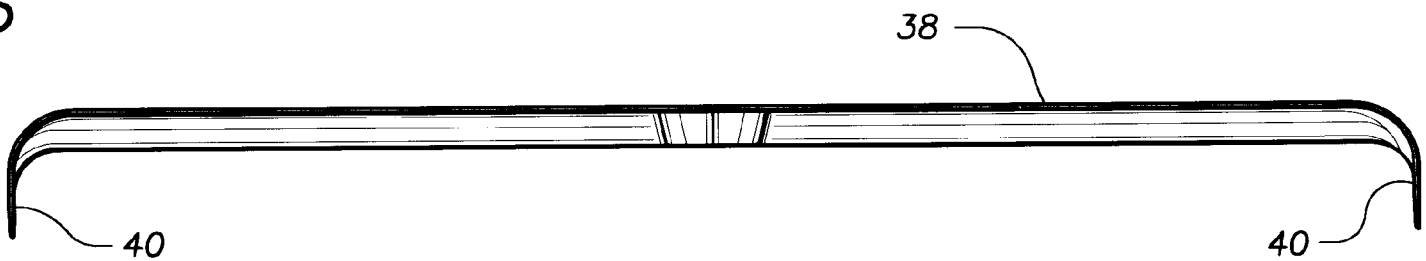
FIG. 6 is a rear plan view of the device of FIG. 2.
Figure 8:
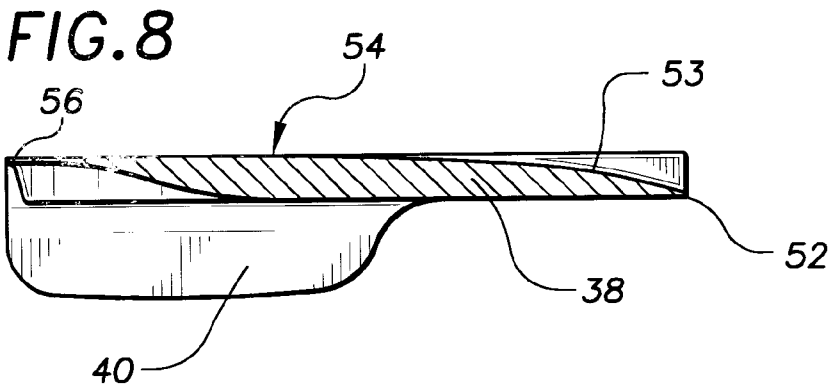
FIG. 8 is a sectional view taken along the line 8—8 in FIG. 2.

Considering FIGS. 2, 4 and 8, it can be seen that the top surface 54 of the rear blade 38 has a progressive downward slope or angle 53 leading to the leading edge 52. Further, as is shown in FIGS. 4 and 8, the lower surface of the leading edge 52 of the rear blade 38 is generally flat. The rear blade 38 is also thinned out on the underside of its trailing edge 56. When the water sport device is underway in the water, the shape of the rear blade 38 effectively provides a downward force on the top of rear blade 38 which reduces the up and down pitch of the device, a motion generally referred to as porpoising.

The flying ski 10 and rider are desirably towed behind a standard powered water craft utilizing a standard ski tow rope, the handle of which is held by the rider (as illustrated in FIG. 1) at a point spaced roughly above the knees of the rider.

The water sports device is preferably provided with a seat belt 58 for securing the buttocks of the rider to the seat to protect the rider from being struck by the device in the event of a fall.

Having fully described the invention, the following claims are intended to particularly point out and distinctly claim the invention.

I claim:

1. In a water sports device for supporting a seated human rider while the rider and the device are towed behind a powered water craft, the device including an elongated board having a front end and a back end to which is secured a seat for supporting the buttocks of the rider in a position spaced from and roughly centered above the back one-third of the board, a holder for securing the feet of the rider over the top of the board secured to the board spaced at least about two feet toward the front end of the board from the seat, an elongated hydrofoil extends downward from the board, front and rear planing blades carried by an arm which is generally parallel to the board, said arm being secured to the hydrofoil and spaced from the board, so that the blades are generally parallel to the board, the planing blades provide essentially no lift when the board is horizontal;

the improvement wherein the distance between the front and rear planing blades is manually adjustable fore and aft by adjustment of the position of the rear blade relative to the front blade so that the advanced rider can adjust the rear blade forward to make the device more responsive and thereby create higher jumps, and the less experienced rider can adjust the rear blade further to the rear of the front blade to make the device less responsive.

2. The water sports device of claim 1, wherein the top surface of the rear planing blade angles downwardly to its leading edge and the lower surface of the leading edge of the rear planing blade is generally flat whereby the device is more stable and less prone to porpoising.

3. The water sports device of claim 1, wherein the rear planing blade extends behind the back end of said board.

4. In a water sports device for supporting a seated human rider while the rider and the device are towed behind a powered water craft, the device including an elongated board having a front end and a back end to which is secured a seat for supporting the buttocks of the rider in a position spaced from and roughly centered above the back one-third of the board, a holder for securing the feet of the rider over the top of the board secured to the board spaced at least about two feet toward the front end of the board from the seat, an elongated hydrofoil extends downward from the board, front and rear planing blades carried by an arm which is generally parallel to the board, said arm being secured to the hydrofoil and spaced from the board, so that the blades are generally parallel to the board, the planing blades provide essentially no lift when the board is horizontal;

the improvement wherein the top surface of the rear planing blade angles downwardly to its leading edge and the lower surface of the leading edge of the rear planing blade is generally flat whereby the device is more stable and less prone to porpoising.

* * * * *